US005573212A

United States Patent [19]

Palazzolo

[11] Patent Number: 5,573,212

[45] Date of Patent: Nov. 12, 1996

[54] GLIDE BLOCK FOR MOVING LOADS

[75] Inventor: Rocco Palazzolo, Brunoy, France

[73] Assignee: Erels Distributing, Paris, France

[21] Appl. No.: 277,915

[22] Filed: Jul. 20, 1994

[30] Foreign Application Priority Data

Sep. 1, 1993 [FR] France ..... 93 10421

[51] Int. Cl.[6] ..... A47B 91/00

[52] U.S. Cl. ..... 248/188.9

[58] Field of Search ..... 248/188.8, 188.9, 248/346.03, 615, 688, 677, 346.11; 16/42 R, 42 T

[56] References Cited

U.S. PATENT DOCUMENTS

| | | | |
|---|---|---|---|
| 771,679 | 10/1904 | Stock | 248/188.9 |
| 1,173,533 | 2/1916 | Neumann . | |
| 1,861,095 | 5/1932 | Schacht . | |
| 1,903,690 | 4/1933 | Schacht | 248/346.1 |
| 1,969,266 | 8/1934 | Herold | 45/137 |
| 2,728,166 | 12/1955 | Molla | 248/188.9 |
| 3,025,631 | 3/1962 | Reynolds | 248/188.9 |
| 3,326,508 | 6/1967 | Born | 248/346.1 |
| 3,742,552 | 7/1973 | Balchunas | 16/42 R |
| 3,883,923 | 5/1975 | England | 248/188.9 |
| 4,575,034 | 3/1986 | Tobey | 248/677 X |
| 4,752,056 | 6/1988 | Culbertson | 248/346.03 X |
| 5,081,740 | 1/1992 | Smith | 16/42 |
| 5,094,416 | 3/1992 | Huon | 248/346.1 |

FOREIGN PATENT DOCUMENTS

| | | | |
|---|---|---|---|
| 217322 | 11/1967 | Sweden | 248/615 |
| 26323 | of 1909 | United Kingdom | 248/188.9 |
| 251207 | 4/1926 | United Kingdom | 248/188.9 |
| 004073 | 1/1989 | United Kingdom | 248/188.8 |

*Primary Examiner*—Ramon O. Ramirez
*Attorney, Agent, or Firm*—Lieberman & Nowak, LLP

[57] ABSTRACT

A glide block for moving loads, notably furniture, comprising a cup containing an elastomer body that includes a housing for a stud provided with a means for fastening it under a piece of furniture. The glide block is characterized in that the stud and its housing are of matching cylindrical shape in general. The stud is made of essentially non-elastic synthetic material and has side projections capable of being accommodated in lateral offsets of the housing in order to constitute detachable means of assembly.

5 Claims, 1 Drawing Sheet

GLIDE BLOCK FOR MOVING LOADS

CROSS-REFERENCES TO RELATED APPLICATIONS

This application claims benefit of the filing date of Sep. 1, 1993 of French Patent Application Number 93.10421.

BACKGROUND OF THE INVENTION

Glide blocks for moving furniture, provided with a cup of synthetic material coming in contact with the floor, are known in the art (see, for example, French patent application No. 90 08159). The cup contains an elastomer body designed to support the load to be moved. In this type of glide block, it is also known that a housing is provided inside the elastomer body, so that the housing is capable of receiving a stud of matching dimensions. The stud is provided with a nail, a screw or other means for fastening it into the piece of furniture to be moved. The fastening means varies lateral positioning of the cup in relation to the piece of furniture.

Further, in the known glide block, a second fastening means is provided on the stud and/or in the housing of the elastomer body to ensure that the cup remains affixed to the stud.

This known glide block is limited however in that the second fastening means does not permit sufficiently rapid, precise and sturdy assembly of the stud to the cup. The lack of precision in positioning of the stud/cup elements leads to premature destruction of the elastomer body.

SUMMARY OF THE INVENTION

The subject invention provides for improvements in known glide blocks and is characterized in that the stud and its housing are of matching cylindrical shape in general. Further, the stud is made of essentially non-elastic synthetic material and has side projections capable of being accommodated by lateral offsets in the housing in order to constitute detachable means of assembly.

According to another characteristic of the invention, the projections are formed by a circular lateral flange provided on the cylindrical stud, said flange being lodged in a circular slit on the side wall of the housing. The flange can also be flat.

According to a further characteristic of the invention, the circular flange forms regularly spaced sectors of a circle.

BRIEF DESCRIPTION OF THE DRAWINGS

The invention is represented by way of non-limiting example in the attached drawings, in which.

DETAILED DESCRIPTION OF THE INVENTION

The subject invention provides a glide block capable of being fastened under a piece of furniture. The glide block is divided into two parts, detachably assembled to each other by means enabling simple, rapid and sturdy fastening.

Figure 1:
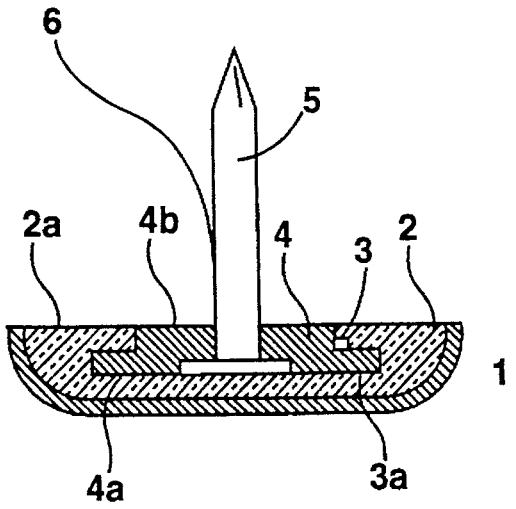
FIG. 1 is a sectional view of an assembled glide block.

The glide block represented in FIG. 1 comprises a cup (1), generally circular in shape. The cup is made of a relatively hard material so that the outer surface is smooth and will produce a low coefficient of friction when contacted with the floor. Inside the cup (1) is placed an elastomer body (2), the upper face (2*a*) of which is situated at the edge of the cup. The elastomer body (2) is fastened to the inner surface of the cup (1) by bonding or by molding. In the axis of the elastomer body (2) a cylindrical housing (3) is provided, preferably of circular section, which has a flat circular groove (3*a*) in its side wall and preferably at its base.

Figure 2:
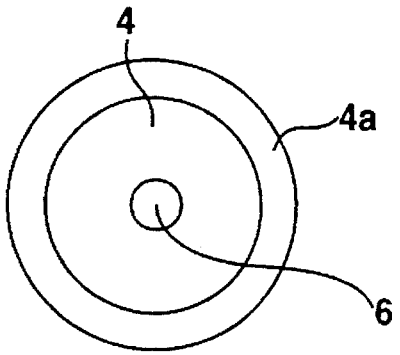
FIG. 2 is a top view of the stud of FIG. 1.

Inside that housing (3), a stud (4) made of relatively hard and, therefore, essentially elastically non-deformable plastic is designed to be detachably assembled. The stud (4) (FIG. 2) has a shape and dimension matching those of the housing (3) and therefore has a circular flange (4*a*) corresponding in shape and dimensions to those of the circular groove (3*a*). The stud (4) is provided in its center, with a hole (6) in which its means of fastening is lodged, preferably a nail (5) or a screw. This arrangement makes possible the detachable, rapid and sturdy assembly of the stud (4) to the elastomer body (2). It also prevents the weight of the load exerted on the surface (2*a*) and on the upper surface (4*b*) of the stud (4) from causing the untimely separation of the two elements, as a result of the deformations sustained by the elastomer body (2).

Thus, when the stud (4) with its nail (5) is disassembled from the cup (1) and the elastomer body (2), it is possible to fasten the stud (4) by means of its nail (5) under the foot of a piece of furniture and then to assemble the cup (1) with the elastomer body (2) on that stud by utilizing the elastic deformation of the elastomer body (2), possibly complemented by a slight deformation of the cup (1).

When the cup (1) is supported on the floor and bears the load of the piece of furniture, a deformation of the elastomer body (2) occurs. However, the means of assembly (3*a*), and (4*a*), prevents the separation of the cup (1) from the stud (4), either when the piece of furniture is lifted and the elastomer body (2) resumes its shape after having been deformed, or when the furniture is slid on the floor, thereby deforming the elastomer body (2).

Figure 3:
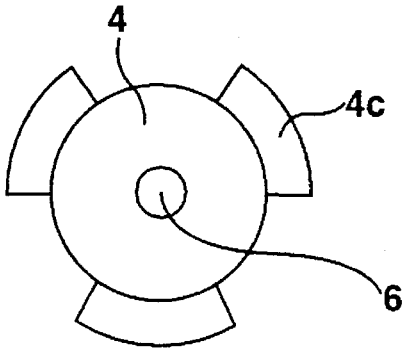
FIG. 3 is a top view of a second embodiment of the stud.

According to the embodiment represented on FIG. 3, the flange (4*c*) is not continuous, but rather comes in the form of three evenly distributed flange sectors, making it possible to facilitate their placement in the flat, thin, circular groove (3*a*) of the elastomer body (2) by deformation of that elastomer body (2) as well as of the cup (1).

The flange configuration shown in FIG. 3 will also make it possible to quickly adapt the dimensions of the cup (1) to the dimensions of the foot of the piece of furniture or to its weight. This can be accomplished leaving the stud (4) and nail (5) assembled to the furniture and replacing the cup with another cup of different diameter, it being understood that each cup contains a housing (3) and circular groove (3*a*) of identical dimensions so that it can be fitted on the same stud (4).

What is claimed is:

1. A glide block which comprises:

a cup of synthetic material having a low friction bottom surface for supporting a load, an elastomeric body within said cup having a defined opening therein communicating with lateral offsets, a stud of synthetic material having side projections for fitting into said lateral offsets of said body to detachably secure said elastomeric body to the stud, the elastomeric body being of sufficient elastomeric properties to permit removal and replacement of the body from the stud, and means for attaching said stud to the bottom of a piece of furniture.

2. A glide block of claim 1, wherein the side projections comprise a circular lateral flange and the lateral offsets comprise a circular groove capable of accepting said circular lateral flange.

3. A glide block of claim 2, wherein the circular lateral flange comprises evenly spaced sectors of a circle.

4. A glide block of claim 2, wherein said flange is flat.

5. A glide block of claim 1 wherein the means for attaching the stud to the load comprises a nail or screw.

* * * * *